US005574260A

United States Patent [19]

Broomall et al.

[11] Patent Number: 5,574,260

[45] Date of Patent: Nov. 12, 1996

[54] COMPOSITE CONDUCTOR HAVING IMPROVED HIGH FREQUENCY SIGNAL TRANSMISSION CHARACTERISTICS

[75] Inventors: James R. Broomall; Christine M. Foster, both of Newark, Del.; Craig R. Theorin; Peter A. Widdoes, both of Landenberg, Pa.

[73] Assignee: W. L. Gore & Associates, Inc., Newark, Del.

[21] Appl. No.: 400,054

[22] Filed: Mar. 6, 1995

[51] Int. Cl.[6] ..... H01B 9/04

[52] U.S. Cl. ..... 174/102 R; 174/106 R; 174/126.1; 174/126.2

[58] Field of Search ..... 174/102 R, 106 R, 174/126.1, 126.2; 333/243, 236

[56] References Cited

U.S. PATENT DOCUMENTS

| | | | |
|---|---|---|---|
| 1,122,675 | 12/1914 | Baldwin . | |
| 1,701,278 | 6/1924 | Silbermann . | |
| 1,904,241 | 4/1933 | Kammerer | 174/126.2 |
| 2,087,408 | 11/1934 | Katzman | 175/41 |
| 2,191,995 | 4/1936 | Scott et al. | 174/36 |
| 2,433,171 | 5/1945 | White | 250/27.5 |
| 2,511,610 | 11/1944 | Wheeler | 178/44 |
| 2,561,462 | 11/1944 | Compton et al. | 175/21 |
| 2,604,594 | 10/1943 | White | 250/33.63 |
| 2,676,309 | 4/1950 | Armstrong | 333/84 |
| 2,769,147 | 5/1951 | Black et al. | 333/27 |
| 2,769,148 | 3/1951 | Clogston | 333/84 |
| 2,769,150 | 11/1952 | Black et al. | 333/96 |
| 2,797,392 | 3/1951 | Clogston | 333/84 |
| 3,573,676 | 4/1971 | Mayer | 333/79 X |
| 3,674,915 | 7/1972 | Pritchard | 174/102 R |
| 3,676,576 | 7/1972 | Dubernet et al. | 174/113 R |
| 4,096,458 | 6/1978 | Martin et al. | 333/96 |
| 4,964,738 | 10/1990 | Lindsay et al. | 381/97 |
| 5,099,518 | 3/1992 | Lindsay et al. | 381/97 |
| 5,118,906 | 6/1992 | Kudoh et al. | 174/130 |
| 5,146,048 | 9/1992 | Yutori et al. | 174/36 |

FOREIGN PATENT DOCUMENTS

| | | | |
|---|---|---|---|
| 563707 | 9/1958 | Canada | 174/126.2 |
| 153607 | 11/1981 | Japan | 174/126.2 |

*Primary Examiner*—Kristine L. Kincaid
*Assistant Examiner*—Chau N. Nguyen
*Attorney, Agent, or Firm*—Victor M. Genco, Jr.

[57] ABSTRACT

A composite conductor having improved high frequency signal transmission characteristics is provided which includes a conductive base and a conductive coating. The relationship between the conductivity and the permeability of the conductive base and the conductive coating is given by the following expression:

$$\frac{\mu_2}{\sigma_2} >> \frac{\mu_1}{\sigma_1}.$$

15 Claims, 2 Drawing Sheets

COMPOSITE CONDUCTOR HAVING IMPROVED HIGH FREQUENCY SIGNAL TRANSMISSION CHARACTERISTICS

FIELD OF THE INVENTION

This invention generally relates to electrical conductors. More particularly, the present invention relates to a composite conductor having improved signal transmission characteristics with respect to high frequency signal attenuation caused by "skin effect".

BACKGROUND OF THE INVENTION

Due to the phenomenon known as "skin effect", at high frequencies the electromagnetic fields and current distribution through a conductor is not uniform. Consider, for example, the case of a flat plane conductor, to which is applied waves of increasing frequency. At zero and sufficiently low frequencies, the electromagnetic field and current distribution are substantially uniformly distributed throughout the conductor, and the effective resistance of the conductor is at a minimum. With increasing frequency, the electromagnetic fields and current amplitudes decrease exponentially with increasing depth into the conductor. For example, the current density distribution in the conductor is given by the expression:

$$J = J_0 e^{-\frac{x}{\delta}}$$

In this case $J_0$ is the current density at the surface of the conductor, x is the depth of penetration into the conductor, and $\delta$ is one skin depth or one skin thickness, which is given by the following expression:

$$\delta = \frac{1}{\sqrt{\pi \mu \sigma f}}$$

where $\delta$ is expressed in meters, $f$ is the frequency of the electromagnetic wave in cycles per second, $\mu$ is the permeability of the conductor in henries per meter, and $\sigma$ is the conductivity of the conductor in mhos per meter.

The factor $\delta$ measures the distance in which the current and field penetrating into a metal many times $\delta$ in thickness will decrease by one neper, i.e. their amplitude will become equal to 1/e=0.36788 . . . times their amplitude at the conductor surface. The total current carried by the conductor may be accurately calculated as a uniform current, equal in amplitude to the value at the surface that penetrates the conductor only to the depth $\delta$.

Strictly speaking, conductors of various geometries will require solutions of the electromagnetic field theory which involve functions other than the exponential solutions which are readily used for the case of a flat plane conductor. However, when the skin depth is small with respect to both the radius of curvature of the conductor surface and the physical extents of the conductor, the exponential solutions can be used with little error.

In practical applications, the impact of the skin effect appears when the skin depth is less than the physical dimensions of the conductor. Since the skin depth is a function of the signal frequency, the range of conductor dimensions over which the skin effect is of interest also depends on the signal frequency. At audio frequencies, there may be little effect, while at radio or microwave frequencies the skin effect may be the dominant factor.

In signal transmission systems and components thereof, at all transmission rates, the skin effect causes some signal distortion due to the variation of both signal attenuation and the relative phase of the signal as compared to frequency. This, of course, limits the useful length of transmission lines in these applications. The loss of signal amplitude, if too severe, requires the use of an amplifier which adds cost, bulk and complexity to the communication system. The frequency dependency of the attenuation characteristics of high frequency signal interconnects is extremely disadvantageous because it makes the equalization of the line on a periodic basis a complex and expensive procedure. In this regard, the equalizers must exhibit a complementary frequency dependent attenuation characteristic which is a function of the physical and electrical properties of the transmission line(s) for a predetermined signal path. In limited situations when signals are transmitted at only one frequency, the use of amplifiers and equalizers may be avoided by the utilization of larger conductors. Of course there is a limit to such a remedy either due to cost, added weight or bulk. Additionally, in most transmission lines, there is a cutoff frequency above which signals will no longer propagate in their preferred mode. This cutoff frequency is a geometrical effect which places an upper limit on the physical dimensions of the conductors used in transmission lines.

An application of the foregoing is disclosed in U.S. Pat. No. 4,096,458 where a plurality of conductors of a high frequency electrical cable each take the form of a central core of insulating material upon which a layer of conductive material is rigidly disposed. It is a principal object of U.S. Pat. No. 4,096,458 to provide a high frequency transmission cable which exhibits an attenuation characteristic which is substantially independent of frequency within a predetermined frequency range. In order to enable this frequency independence, the thickness of the conductive layer is limited to a calculated multiple of the conductor skin depth in the predetermined frequency range. In this regard, at low frequency operation, a conductive coating layer, such as a metal foil, may be wrapped about the central core of insulating material. However, at higher frequencies of interest, it may not be practical or economical to fabricate conductive coating layers of an appropriate thickness about a central core of insulating material to achieve an attenuation characteristic which is substantially independent of frequency within a predetermined frequency range.

The foregoing illustrates limitations known to exist in present conductors. Thus, it is apparent that it would be advantageous to provide a conductor having improved high frequency signal transmission characteristics directed to overcoming one or more of the limitations set forth above. Accordingly, a suitable alternative is provided including features more fully disclosed hereinafter.

SUMMARY OF THE INVENTION

The present invention advances the art of conductors for high frequency signal transmission, and the techniques for creating such a conductor, beyond which is known to date. In one aspect of the present invention, a composite conductor is provided having improved high frequency signal transmission characteristics. The composite conductor includes a conductive base and a conductive coating disposed upon the conductive base. The relationship between the ratio of permeability to conductivity of the conductive base to that of the conductive coating is given by the following expression:

$$\frac{\mu_2}{\sigma_2} >> \frac{\mu_1}{\sigma_1}$$

(As should be understood, throughout, the teachings herein, subscript (1) refers to the conductive coating layer and subscript (2) refers to the conductive base layer.) The attenuation of a high frequency signal propagating through the composite conductor is substantially independent of frequency within a predetermined frequency range of said signal. The conductive base may be comprised of a material selected from a group consisting of, but not limited to, iron, nickel, alloys containing iron, and alloys containing nickel. The conductive coating may be comprised of a material selected from a group consisting of, but not limited to, silver, copper, gold, aluminum and tin. The conductive coating may have a thickness substantially equal to the skin depth of the conductive coating.

In another aspect of the present invention, a composite conductor having improved high frequency signal transmission includes a first conductive layer comprised of a material having good thermal conductivity, a second conductive layer disposed upon the first conductive layer, and a third conductive layer disposed upon the second conductive layer. The first conductive layer may be comprised of copper. The second conductive layer may be comprised of a material selected from a group consisting of iron, nickel, alloys containing iron, and alloys containing nickel. The third conductive layer may be comprised of a material selected from a group consisting of silver, copper, gold, aluminum and tin. The relationship between the conductivity and permeability of the second conductive layer and the third conductive layer is given by the following expression:

$$\frac{\mu_2}{\sigma_2} >> \frac{\mu_1}{\sigma_1}$$

The attenuation of a high frequency signal propagating through the composite conductor of such a construction is substantially independent of frequency within a predetermined frequency range of said signal.

It is, therefore, a purpose of the present invention to provide a conductor for high frequency signal transmission which exhibits an attenuation characteristic which is substantially independent of frequency within a predetermined frequency range.

It is another purpose of the present invention to provide such a conductor for high frequency signal transmission which reduces non-linear signal phase response, with respect to frequency, of the conductor.

It is another purpose of the present invention to provide such a conductor for high frequency signal transmission which permits the tailoring of the attenuation and phase response of the conductor as a function of frequency.

It is yet another purpose of the present invention to provide such a conductor which effectively reduces high frequency signal attenuation.

The foregoing and other aspects will become apparent from the following detailed description of the invention when considered in conjunction with the accompanying drawing figures.

DETAILED DESCRIPTION OF THE INVENTION

Figure 1:
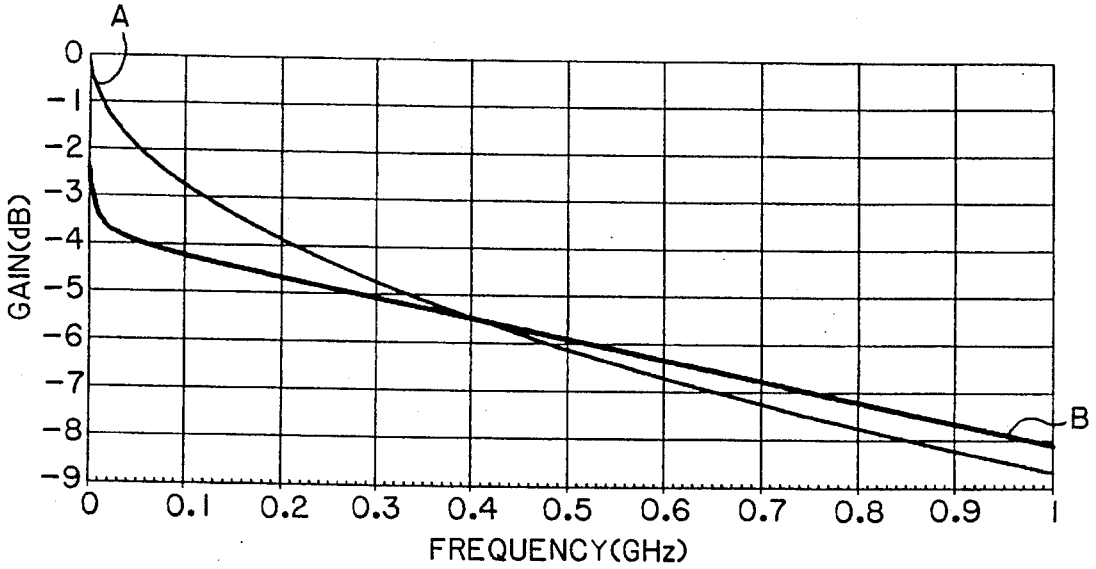
FIG. 1 (PRIOR ART)
FIG. 1 is a graph of Gain (dB) versus Frequency (GHz) showing plots for both a prior art coaxial cable and a coaxial cable made in accordance with the teachings of the present invention, wherein the plot of the prior art coaxial cable is labeled "A", and the plot of the novel coaxial cable is labeled "B".

Quantification of the skin depth of a conductor is particularly significant in determining the attenuation of a predetermined electrical signal through a transmission line, or other suitable, electrically conductive, signal transmission medium. The exponential solution for electromagnetic fields and current provides a simplified representation of the current distribution in which the total current in the conductor is limited to a layer of thickness equal to the skin depth. In the case of a solid conductor, the effective limitation of current with respect to one skin depth establishes an effective surface resistance, per unit width and unit length of the conductor, which is given by the expression:

$$R_S = \frac{1}{\sigma\delta}$$

The attenuation, per unit length, of a transmission line due to this surface resistance is given by the expression:

$$\alpha = \frac{R_S}{2wZ_0}$$

where w is the width of the surface of the conductor and $Z_0$ is the characteristic impedance of the transmission line. In such instances when the exponential approximations are valid, the internal inductance of the conductor, per unit width and unit length, is given by the expression:

$$L_i = \frac{R_S}{2\pi f}$$

The frequency dependence of this internal inductance causes a phase shift of a signal at one frequency compared to signals at other frequencies.

A reduction in the surface resistance per unit length of the conductor will cause an improvement in the signal transmission quality and increase the maximum usable length of a transmission line. If a coated conductor is used, surface impedance, per unit width and unit length, is given by the expression:

$$Z = (1+j)R_{S_1}\left[\frac{\sinh\tau_1 d + \frac{R_{S_2}}{R_{S_1}}\cosh\tau_1 d}{\cosh\tau_1 d + \frac{R_{S_2}}{R_{S_1}}\sinh h\tau_1 d}\right]$$

where subscript (1) refers to a conductive coating layer; subscript (2) refers to a conductive base layer; $j=\sqrt{-1}$; $R_{S_1}$ and $R_{S_2}$ are as defined hereinabove but for layers (1) and (2); $\tau_1=(1+j)\sqrt{\pi f \mu_1 \sigma_1}$; and d is the thickness of the conductive coating layer. In this case then, the effective surface resistance becomes $R_{S_e}=\mathrm{Re}(Z)$ and the effective internal inductance becomes $L_{i_e}=\mathrm{Im}(Z)/2\pi f$, where the real and imaginary parts of Z are used.

The foregoing expression for Z reduces to $$Z = (1=j)R_{S_1}\left[\frac{\cosh\tau_1 d}{\sinh h\tau_1 d}\right]$$

in the case where $R_{S_2} \gg R_{S_1}$, and the effective attenuation becomes $$a_e = \frac{1}{2wZ_0}\, Re\left[(1+j)R_{S_1}\left(\frac{\cosh\tau_1 d}{\sinh\tau_1 d}\right)\right]$$

For purposes of example only, in a case where a base layer of a coated conductor is an insulating material, then clearly $R_{S_2} \gg R_{S_1}$. It can be shown that if the thickness of the conductive coating is properly determined relative to the skin depth of the conductive coating, the attenuation of a signal propagating through such a coated conductor will be substantially independent of frequency.

The essence of the present invention is that a composite conductor can be achieved, wherein the attenuation of a signal propagating through the composite conductor is substantially independent of the frequency of the propagating signal, and such a composite conductor is defined by a conductive base layer and a conductive coating layer.

In accordance with the teachings herein, the conductive base layer and the conductive coating layer of the composite conductor of the present invention are selected from those materials which establish a condition wherein $R_{S_2} \gg R_{S_1}$. In this case, the attenuation of the propagating signal through the composite conductor will be substantially independent of the frequency of the signal. More particularly, by combining the expression for skin depth $\delta$ with the relationship for the surface resistance $R_S$, it can be seen that $R_S$ may be directly stated in terms of material properties as provided in the following expression:

$$R_S = \sqrt{\pi f}\ \sqrt{\frac{\mu}{\sigma}}$$

Accordingly, the relationship $R_{S_2} \gg R_{S_1}$ can be directly restated in terms of the material properties of the conductive base layer and the conductive coating layer as provided in the following expression:

$$\frac{\mu_2}{\sigma_2} \gg \frac{\mu_1}{\sigma_1}$$

A composite conductor made in accordance with the teachings of the present invention will incorporate a conductive base layer which has a lower conductivity and/or a higher permeability with respect to the conductive coating layer such that $R_{S_2} \gg R_{S_1}$.

Materials which may be particularly suitable for the conductive coating layer of the composite conductor of the present invention are those materials which have a high conductivity and/or a low permeability relative to the conductive base layer, such as but not limited to silver, copper, gold, aluminum or tin. Additionally, materials which may be particularly suitable for establishing a conductive base layer of the composite conductor of the present invention are those materials which have a low conductivity and/or high permeability relative to the conductive coating layer, such that $R_{S_2} \gg R_{S_1}$. Suitable conductive base materials include, but are not limited to, iron, nickel, or alloys containing iron and/or nickel. Such materials permit current density to be increased in a highly conductive coating layer by increasing the surface resistance of the conductive base layer.

As should be understood, the effect on the internal impedance of the composite conductor of the present invention is to provide such a conductor for high frequency signal transmission which permits the tailoring of the attenuation and phase response of the conductor as a function of frequency. More particularly, by varying the thickness of the conductive coating layer and the material properties of both the conductive base and conductive coating layers, the response of signal phase and attenuation with respect to frequency may be adjusted. In this regard, the larger $R_{S_2}$ is with respect to $R_{S_1}$, the more linear the signal attenuation and signal phase become as a function of the frequency of the signal. For a composite conductor made in accordance with the teachings of the present invention, where the thickness of the conductive coating layer is significantly less than the skin depth of the conductive coating layer, at all frequencies within a predetermined frequency range, it will be appreciated that the attenuation of the composite conductor will be substantially independent of frequency within said frequency range. As one skilled in the art would also appreciate, as the conductive coating layer thickness is made significantly greater with respect to skin depth, at all frequencies within a predetermined frequency range, the attenuation will become substantially equal to that of a solid conductor. Suprisingly, in a narrow range of conductive coating layer thicknesses from approximately 1.4 to 2.0 times the skin depth, the attenuation, at frequencies near the frequency corresponding to the skin depth, will be less than that of a solid conductor of the same material of that of the conductive coating layer. By varying the coating layer thickness over a range of values, preferably from one half the skin depth to five times the skin depth, a variety of desirable frequency responses may be obtained.

The present invention is directed to a composite conductor having a conductive base layer and a conductive coating layer wherein the conductive base layer has a lower conductivity and/or a higher permeability with respect to the conductive coating layer such that $R_{S_2} \gg R_{S_1}$. Such a composite conductor may be defined by a range of configurations such as, but not limited to coaxial cables, twisted pairs, shielded twisted pairs, flat multiple conductor cables, flexible circuits, wave guides, antennae, printed circuit board conductors, resonators and single conductors of any cross section. The conductive coating layer may be disposed upon the conductive base by methods which are generally known, such as but not limiting to electroplating, electroless plating, or vacuum vapor deposition, for example. Without intending to limit the scope of the present invention, FIGS. 3A through 5C illustrate configurations of various composite conductors made in accordance with the teachings of the present invention.

Figure 3A:
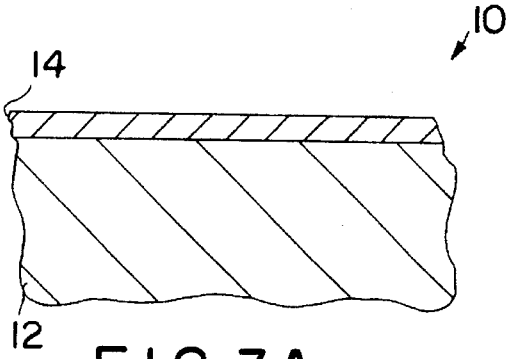
FIG. 3A is a fragmented cross sectional view of a composite conductor made in accordance with the teachings of the present invention and having two conductive layers.

Referring now to FIG. 3A, there is shown generally at 10 a fragmented cross sectional view of a composite conductor made in accordance with the teachings of the present invention. Composite conductor 10 is defined by a conductive base 12 and a conductive coating layer 14. FIG. 4B generally illustrates at 10 a cross sectional view of a substantially cylindrically shaped composite conductor having a conductive base 12 and a conductive coating layer 14.

Figure 3B:
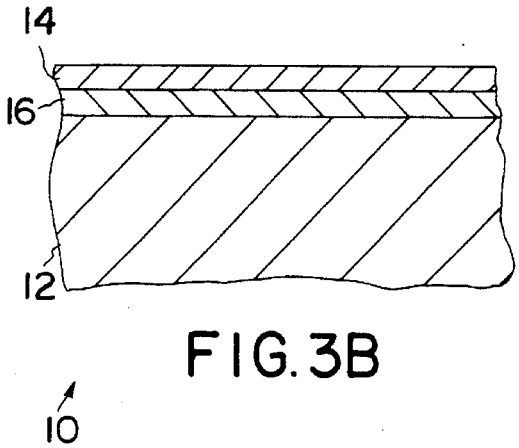
FIG. 3B is a fragmented cross sectional view of an alternate embodiment of the composite conductor of the present invention and having three conductive layers.
Figure 4A:
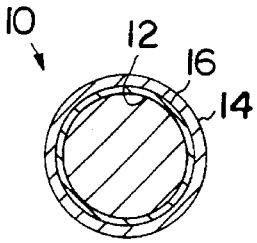
FIG. 4A is a cross sectional view of a substantially cylindrically shaped composite conductor of the present invention having three conductive layers.
Figure 4B:
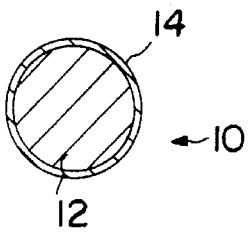
FIG. 4B is a cross sectional view of a substantially cylindrically shaped composite conductor of the present invention having two conductive layers.

FIGS. 3B and 4A are composite conductors similar to those illustrated in FIGS. 3A and 4B, however, the composite conductors of FIGS. 3B and 4A are defined by multiple layers of conductive materials, i.e. more than two layers. Each layer of conductive material of the composite conductors of FIGS. 3B and 4A has a different magnetic permeability relative to the other conductive layers of an individual composite conductor. Such a configuration may be useful to tailor the attenuation, phase and other physical properties of such a composite conductor for a variety of purposes. For example, in the case of high power applications, such as application of the composite conductor within certain radar systems, achieving the minimum attenuation for a given cable size and weight is very significant. The high power used by the radar system generates substantial heat which must be dissipated from the cable assembly. In order to achieve the minimum attenuation while maintaining adequate thermal conductivity, a multiple layer conductor would be desirable. In such an example, and as best illustrated in FIGS. 3B and 4A, the conductive base material 12 may be comprised of a material which has good thermal conductivity, such as copper, for example. Disposed upon layer 12 may be a layer 16 comprising, for example iron, nickel, or alloys containing iron and/or nickel to provide a high permeability in accordance with the teachings herein. A top conductive coating layer 14 may be a highly conductive material to provide a high electrical conductivity.

The theoretical basis of a composite conductor having multiple layers of conductive materials may be extended by solving a boundary value problem with appropriate boundary conditions at each interface between successive layers. In the three layer example of FIGS. 3B and 4A, such a solution shows that a nickel layer of several skin depths thickness is adequate to provide the redistribution of current desired.

Figure 5A:
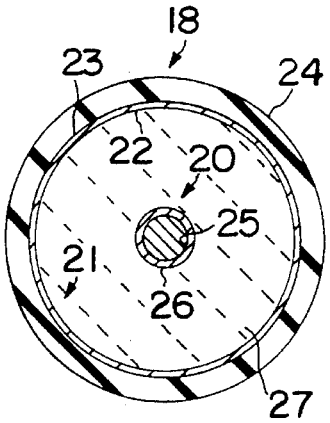
FIG. 5A is a diagrammatic cross sectional view of a coaxial cable of the present invention having a center conductor defined by two conductive layers and an outer conductor defined by two conductive layers.
Figure 5B:
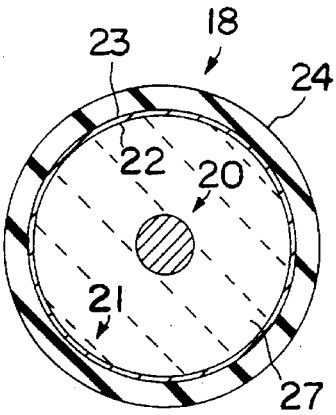
FIG. 5B is a diagrammatic cross sectional view of a coaxial cable of the present invention having a center conductor defined by a single conductive layer and an outer conductor defined by two conductive layers.
Figure 5C:
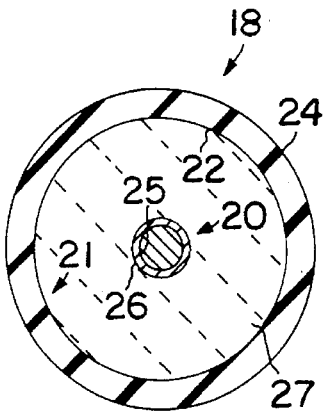
FIG. 5C is a diagrammatic cross sectional view of a coaxial cable of the present invention having a center conductor defined by two conductive layers and an outer conductor defined by a single conductive layer.

FIGS. 5A–5C illustrate various coaxial cables 18 made in accordance with the teachings of the present invention. These coaxial cables are each defined by a center conductor 20, a suitable dielectric material 27, an outer conductor 21, a metallic braid (not shown) and an insulating jacket material 24.

The coaxial cable 18 of FIG. 5A is defined by a center conductor 20 having a conductive base layer 25 and a conductive coating layer 26. The outer conductor 21 of this coaxial cable is defined by a conductive coating layer 22 and a conductive base layer 23. Both the center conductor 20 and the outer conductor 21 incorporate conductive base layers 25 and 23 which have a lower conductivity and/or a higher permeability with respect to respective conductive coating layers 26 and 22, such that $R_{S_2} >> R_{S_1}$ for both the center conductor 20 and the outer conductor 21.

The coaxial cable 18 of FIG. 5B is defined by a conventional center conductor 20. The outer conductor 21 of this coaxial cable is defined by a conductive coating layer 22 and a conductive base layer 23 such that $R_{S_2} >> R_{S_1}$ for the outer conductor 21.

The coaxial cable 18 of FIG. 5C is defined by a center conductor 20 having a conductive base layer 25 and a conductive coating layer 26. The outer conductor 21 is conventional in design. The center conductor 20 of this coaxial cable is defined by a conductive coating layer 26 and a conductive base layer 25 such that $R_{S_2} >> R_{S_1}$ for the center conductor 20.

PRIOR ART

The prior art coaxial cable which was provided as a reference against which the teachings of the present invention were tested, and which was illustrated in FIG. 1 as plot "A", included a 0.016 inch diameter solid copper center conductor having approximately 60 microinches of silver plating. An expanded polytetrafluoroethylene (PTFE) dielectric material was wrapped about the center conductor to a diameter required to produce a characteristic impedance of 50 ohms. A served flat foil copper outer conductor material included approximately 60 microinches of silver plating. About the outer conductor material was a silver plated copper braid of AWG-40 wire. A coaxial cable insulating jacket was comprised of perfluoroalkoxy polymer (PFA).

Without intending to limit the scope of the present invention, the novel composite conductor taught herein may be better understood by referring to the following example:

EXAMPLE 1

A coaxial cable was made in accordance with the teachings of the present invention. Testing results of this coaxial cable have been illustrated in FIG. 1 as plot "B". This coaxial cable was provided with a conductive base material defined by a 0.016 inch diameter solid iron and nickel alloy center conductor (NILO alloy 52 obtained from INCO Alloys International, Inc., of 3200 Riverside Drive, Huntington, W. Va.). Disposed upon the conductive base material was a conductive coating layer defined by approximately 160 microinches of silver plating. The conductive coating layer was disposed upon the conductive base material by an electroplating process provided by The MWS Wire Company, of 31200 Cedar Valley Drive, Westlake Village, Calif. A dielectric of expanded PTFE tape was wrapped about the center conductor to a predetermined diameter which was required to produce a characteristic impedance of 50 ohms. The outer conductor was comprised of a served flat copper foil having approximately 60 microinches of silver plating. About the outer conductor material was a silver plated copper braid of AWG-40 wire. A coaxial cable insulating jacket was comprised of perfluoroalkoxy polymer (PFA).

TESTING

Signal magnitude and phase response measurements of the composite conductor of the present invention were measured in reference to the signal that would be transmitted if the composite conductor, i.e. the device under test (DUT) were not present. These measurements are summarized in FIGS. 1 and 2 which are described in detail hereinafter. Testing of the composite conductor of the present invention was accomplished with a vector network analyzer consisting of a signal source and receiver. The frequency span over which the data was to be gathered was determined, and testing calibration was accomplished by connecting the receiver to the signal source using a suitable length of cable. Full two port non-insertable device calibration was performed using a standard 12 term error model. The baseline signal, as a function of the frequency, was stored in the vector network analyzer. After storing the baseline data, the connection between the source and receiver was interrupted, and the DUT was inserted serially in the signal path. Measurements were taken at the predetermined frequencies of interest, and the DUT data was corrected automatically by the analyzer in reference to the calibration.

The attenuation measurements have been presented in decibels (dB), with negative numbers indicating loss of signal. More particularly, if $P_0$ is the signal power which would be transmitted from signal source to a receiver without the DUT present, when the DUT is inserted into the signal path the attenuation in dB becomes $$a = 10\log\left(\frac{P}{P_0}\right)$$

where P is the signal power that is received with the DUT inserted into the signal path.

The phase measurements have been presented in terms of phase slope with respect to frequency (degrees/MHz). In a signal transmitting system, the delay of the signal caused by the system can be characterized by the number of cycles of the signal that will occur as the signal traverses the system. This can be enumerated in terms of degrees, at 360 degrees per cycle. If the system is linear with phase, the signal delay will be directly proportional to the signal frequency, or in other terms, the slope of signal phase with respect to frequency will be a constant versus frequency. Under these circumstances a graph of phase slope versus frequency should be a flat horizontal line.

FIG. 1 shows the gain versus frequency response for both a 10.5 meter long sample of the prior art coaxial cable described hereinabove, labeled as plot "A", and a 10.5 meter long sample of a coaxial cable made in accordance with the present invention, and labeled as plot "B". The data was taken from 300 KHz to 1 GHz. The prior art cable displays the predominant square root of frequency dependence that is expected. The coaxial cable of the present invention cable shows a predominantly linear frequency response over a wide range of frequencies. There is a cross over in attenuation at about 400 MHz, with the coaxial cable of the present invention showing lower attenuation from that frequency up to the maximum frequency of the graph. The thickness of plating for this cable has been optimized to provide the minimum attenuation at 1 GHz. If it had been decided to decrease the coating layer thickness, the cable attenuation would have shown less frequency dependence, but would however have shown a higher overall attenuation.

Figure 2:
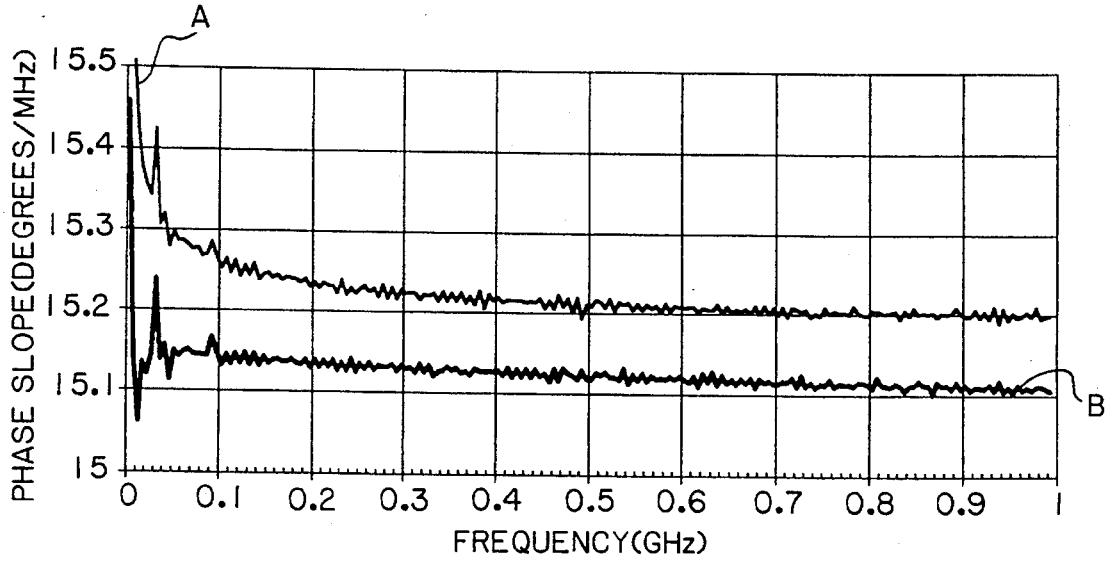
FIG. 2 (PRIOR ART)
FIG. 2 is a graph of Phase Slope (degrees/MHz) versus Frequency (GHz) showing plots for both a prior art coaxial cable and a coaxial cable made in accordance with the teachings of the present invention, wherein the plot of the prior art coaxial cable is labeled "A", and the plot of the novel coaxial cable is labeled "B".

FIG. 2 shows the phase slope versus frequency responses for the same samples as shown in FIG. 1. The prior art cable shows a more substantial change of the slope of phase versus frequency compared to the coaxial cable of the present invention. The effect on signal transmission would be that a signal comprised of multiple frequency components being transmitted with the coaxial cable of the present invention would show significantly less phase distortion than a signal being transmitted on a prior art cable.

Although a few exemplary embodiments of the present invention have been described in detail herein, those skilled in the art readily appreciate that many modifications are possible without materially departing from the novel teachings and advantages which are described herein. Accordingly, all such modifications are intended to be included within the scope of the present invention, as defined by the following claims.

Having described the invention, what is claimed is:

1. A composite conductor having improved high frequency signal transmission characteristics comprising:

a conductive base having a permeability $\mu_2$ and a conductivity $\sigma_2$; and a conductive coating disposed upon the conductive base, the conductive coating having a permeability $\mu_1$ and a conductivity $\sigma_1$, such that $$\frac{\mu_2}{\sigma_2} >> \frac{\mu_1}{\sigma_1}.$$

wherein the conductive coating has a thickness ranging from about one-half to about five times a skin depth of said coating; and wherein a current distribution of the composite conductor is redistributed from the conductive base to the conductive coating by employing a conductive base having a higher surface resistance than the conductive coating.

2. A composite conductor having improved high frequency signal transmission characteristics, as claimed in claim 1, wherein the conductive base is comprised of a material selected from a group consisting of iron, nickel, alloys containing iron, and alloys containing nickel.

3. A composite conductor having improved high frequency signal transmission characteristics, as claimed in claim 1, wherein the conductive coating is comprised of a material selected from a group consisting of silver, copper, gold, aluminum and tin.

4. A composite conductor having improved high frequency signal transmission characteristics, as claimed in claim 1, wherein the conductive coating has a thickness substantially equal to the skin depth.

5. A composite conductor having improved high frequency signal transmission characteristics comprising:

a material having a predetermined high thermal conductivity;

a conductive base layer disposed upon said highly thermally conductive material, the conductive base layer having a permeability $\mu_2$ and a conductivity $\sigma_2$; and a conductive coating layer disposed upon the conductive base layer, the conductive coating layer having a permeability $\mu_1$ and a conductivity $\sigma_1$, such that $$\frac{\mu_2}{\sigma_2} >> \frac{\mu_1}{\sigma_1}$$

wherein the conductive coating has a thickness ranging from about one-half to about five times a skin depth of said coating; and wherein a current distribution of the composite conductor is redistributed from the conductive base layer to the conductive coating layer by employing a conductive base layer having a higher surface resistance than the conductive coating layer.

6. A composite conductor having improved high frequency signal transmission characteristics, as claimed in claim 5, wherein said highly thermally conductive material is copper.

7. A composite conductor having improved high frequency signal transmission characteristics, as claimed in claim 5, wherein the conductive base layer is comprised of a material selected from a group consisting of: iron, nickel, alloys containing iron, and alloys containing nickel.

8. A composite conductor having improved high frequency signal transmission characteristics, as claimed in claim 5, wherein the conductive coating layer is comprised of a material selected from a group consisting of: silver, copper, gold, aluminum and tin.

9. A composite conductor having improved high frequency signal transmission characteristics, as claimed in claim 5, wherein the conductive coating layer has a thickness substantially equal to the skin depth.

10. A coaxial cable having improved high frequency signal transmission characteristics comprising:

a center conductor comprising:

a conductive base having a permeability $\mu_2$ and a conductivity $\sigma_2$; and a conductive coating disposed upon the conductive base, the conductive coating having a permeability $\mu_1$ and a conductivity $\sigma_1$, such that $$\frac{\mu_2}{\sigma_2} >> \frac{\mu_1}{\sigma_1}$$

wherein the conductive coating has a thickness ranging from about one-half to about five times a skin depth of said coating; and wherein a current distribution of the composite conductor is redistributed from the conductive base to the conductive coating by employing a conductive base having a higher surface resistance than the conductive coating;

a dielectric material disposed about the center conductor;

an outer conductor disposed about the dielectric material; and an insulating jacket disposed about the outer conductor.

11. A coaxial cable as claimed in claim 10 wherein the conductive base of the center conductor is comprised of a material selected from a group consisting of iron, nickel, alloys containing iron, and alloys containing nickel.

12. A coaxial cable as claimed in claim 11 wherein the conductive coating of the center conductor is comprised of a material selected from a group consisting of silver, copper, gold, aluminum and tin.

13. A coaxial cable as claimed in claim 12 wherein the conductive coating has a thickness substantially equal to the skin depth.

14. A coaxial cable having improved high frequency signal transmission characteristics comprising:

a center conductor defined by a conductive base, and a conductive coating disposed upon the conductive base such that $$\frac{\mu_2}{\sigma_2} >> \frac{\mu_1}{\sigma_1}.$$

a dielectric material disposed about the center conductor;

an outer conductor disposed about the dielectric material, the outer conductor being defined by, a) a conductive base; and b) a conductive coating disposed upon the conductive base such that $$\frac{\mu_2}{\sigma_2} >> \frac{\mu_1}{\sigma_1}; \text{ and}$$

an insulating jacket disposed about the outer conductor.

15. A coaxial cable having improved high frequency signal transmission characteristics comprising:

a center conductor;

a dielectric material disposed about the center conductor;

an outer conductor disposed about the dielectric material, the outer conductor comprising:

a) a conductive base; and b) a conductive coating disposed upon the conductive base such that $$\frac{\mu_2}{\sigma_2} >> \frac{\mu_1}{\sigma_1}.$$

an insulating jacket disposed about the outer conductor.

* * * * *

US005574260B1

REEXAMINATION CERTIFICATE (3979th)

United States Patent [19] [11] B1 5,574,260

Broomall et al. [45] Certificate Issued Jan. 18, 2000

[54] COMPOSITE CONDUCTOR HAVING IMPROVED HIGH FREQUENCY SIGNAL TRANSMISSION CHARACTERISTICS

[75] Inventors: James R. Broomall; Christine M. Foster, both of Newark, Del.; Craig R. Theorin; Peter A. Widdoes, both of Landenberg, Pa.

[73] Assignee: W. L. Gore & Associates, Inc., Newark, Del.

Reexamination Request:
No. 90/004,864, Dec. 9, 1997

Reexamination Certificate for:

| | |
|---|---|
| Patent No.: | **5,574,260** |
| Issued: | **Nov. 12, 1996** |
| Appl. No.: | **08/400,054** |
| Filed: | **Mar. 6, 1995** |

[51] Int. Cl.[7] ..... H01B 9/04

[52] U.S. Cl. ..... 174/102 R; 174/106 R; 174/126.1; 174/126.2

[58] Field of Search ..... 174/102 R, 106 R, 174/126.1, 126.2; 333/236, 243, 170; 365/139

[56] References Cited

U.S. PATENT DOCUMENTS

| | | | |
|---|---|---|---|
| 1,904,241 | 4/1933 | Kammerer | 174/126.2 X |
| 3,704,434 | 11/1972 | Schlachter | 333/170 |
| 3,959,785 | 5/1976 | Nichols et al. | 365/139 |
| 4,017,344 | 4/1977 | Lorber et al. | 156/52 |
| 4,275,317 | 6/1981 | Laudenslager et al. | 307/415 |
| 4,522,890 | 6/1985 | Volkers et al. | 428/624 |

OTHER PUBLICATIONS

Beldon Master Catalog (1995).
Military Specification, "Cables, Radio Frequency, Flexible and Semirigid", Department of Defense, Jan. 18, 1983.

*Primary Examiner*—Kristine Kincaid

[57] ABSTRACT

A composite conductor having improved high frequency signal transmission characteristics is provided which includes a conductive base and a conductive coating. The relationship between the conductivity and the permeability of the conductive base and the conductive coating is given by the following expression:

$$\frac{\mu_2}{\sigma_2} \gg \frac{\mu_1}{\sigma_1}.$$

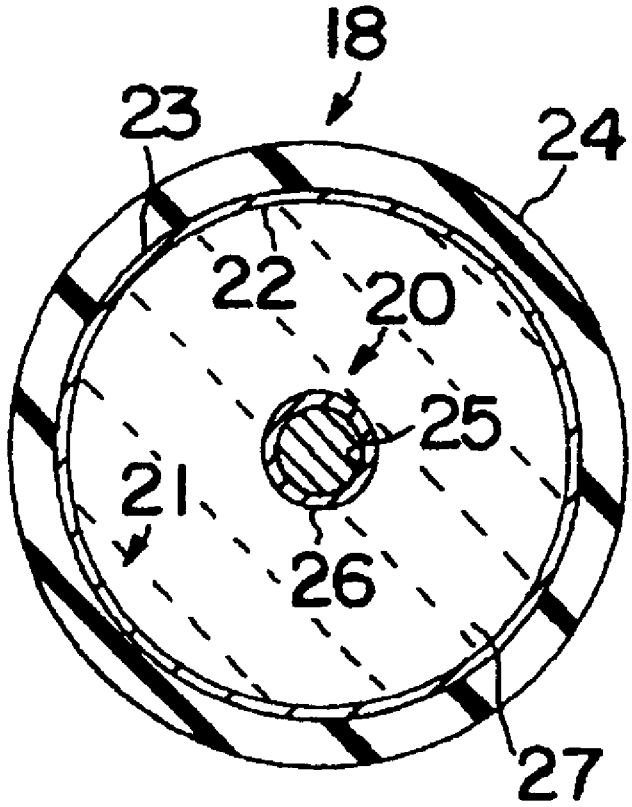

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 14 and 15 is confirmed.

Claims 1, 5 and 10 are determined to be patentable as amended.

Claims 2–4, 6–9 and 11–13, dependent on an amended claim, are determined to be patentable.

1. A composite conductor having improved high frequency signal transmission characteristics comprising:

a conductive base having a permeability $\mu_2$ and a conductivity $\sigma_2$; and a conductive coating disposed upon the conductive base, the conductive coating having a permeability $\mu_1$ and a conductivity $\sigma_1$, such that $$\frac{\mu_2}{\sigma_2} \gg \frac{\mu_1}{\sigma_1}$$

wherein the conductive coating has a thickness ranging from about one-half to about five times a skin depth of said coating; [and]

wherein a current distribution of the composite conductor is redistributed from the conductive base to the conductive coating by employing a conductive base having a higher surface resistance than the conductive coating*;*

*wherein a signal propagated through said composite conductor, lengthwise of said composite conductor, has a frequency and an amount of attenuation; and*

*wherein said amount of attenuation is substantially independent of said frequency of said signal.*

5. A composite conductor having improved high frequency signal transmission characteristics comprising:

a material having a predetermined high thermal conductivity;

a conductive base layer disposed upon said highly thermally conductive material, the conductive base layer having a permeability $\mu_2$ and a conductivity $\sigma_2$; and a conductive coating layer disposed upon the conductive base layer, the conductive coating layer having a permeability $\mu_1$ and a conductivity $\sigma_1$, such that $$\frac{\mu_2}{\sigma_2} \gg \frac{\mu_1}{\sigma_1}$$

wherein the conductive coating has a thickness ranging from about one-half to about five times a skin depth of said coating; [and]

wherein a current distribution of the composite conductor is redistributed from the conductive base layer to the conductive coating layer by employing a conductive base layer having a higher surface resistance than the conductive coating layer*;*

*wherein a signal propagated through said composite conductor, lengthwise of said composite conductor, has a frequency and an amount of attenuation; and*

*wherein said amount of attenuation is substantially independent of said frequency of said signal.*

10. A coaxial cable having improved high frequency signal transmission characteristics comprising:

a center conductor comprising:

a conductive base having a permeability $\mu_2$ and a conductivity $\sigma_2$; and a conductive coating disposed upon the conductive base, the conductive coating having a permeability $\mu_1$ and a conductivity $\sigma_1$, such that $$\frac{\mu_2}{\sigma_2} \gg \frac{\mu_1}{\sigma_1}$$

wherein the conductive coating has a thickness ranging from about one-half to about five times a skin depth of said coating; and wherein a current distribution of the composite conductor is redistributed from the conductive base to the conductive coating by employing a conductive base having a higher surface resistance than the conductive coating;

a dielectric material disposed about the center conductor;

an outer conductor disposed about the dielectric material; and an insulating jacket disposed about the outer conductor*;*

*wherein a signal propagated through said coaxial cable, lengthwise of said coaxial cable, has a frequency and an amount of attenuation; and*

*wherein said amount of attenuation is substantially independent of said frequency of said signal.*

* * * * *